US005657943A

United States Patent [19]

Nugent

[11] Patent Number: 5,657,943

[45] Date of Patent: Aug. 19, 1997

[54] FLEXIBLE BAG WINDING AND UNWINDING APPARATUS

[75] Inventor: Meredith Nugent, St. Paul, Ind.

[73] Assignee: KCL Corporation, Shelbyville, Ind.

[21] Appl. No.: 535,619

[22] Filed: Sep. 28, 1995

[51] Int. Cl.[6] ..... B65H 75/28

[52] U.S. Cl. ..... 242/532.6; 242/533.8; 242/537; 242/613.3

[58] Field of Search ..... 242/532.6, 532, 242/537, 540, 541.1, 541.3, 533.8, 533, 390, 403, 613.1, 613.2, 613.3, 50

[56] References Cited

U.S. PATENT DOCUMENTS

| | | | |
|---|---|---|---|
| 2,896,872 | 7/1959 | Dresser | 242/537 |
| 3,237,363 | 3/1966 | Spohr | 242/532.6 X |
| 4,432,502 | 2/1984 | Varkia et al. | 242/613.3 X |
| 4,558,556 | 12/1985 | Jostler | 53/459 |
| 4,598,421 | 7/1986 | Jostler | 383/37 |
| 4,756,144 | 7/1988 | Jostler | 53/568 |
| 4,807,817 | 2/1989 | Schoewe | 242/532.6 X |

OTHER PUBLICATIONS

Joker System—Joker Combi Line Packaging System; Brochure, Joker System AB (no date avl).

*Primary Examiner*—Daniel P. Stodola
*Assistant Examiner*—William A. Rivera
*Attorney, Agent, or Firm*—Woodard, Emhardt, Naughton, Moriarty & McNett

[57] ABSTRACT

A vertical winding apparatus includes a winding core generally formed from a flat sheet and having an irregular trapezoidal shape for supporting a continuous belt of packaging blanks. The winding core includes an upper bar separated from a lower body by a pair of opposite support notches which are configured to receive the upper edge of the continuous belt of packaging blanks. Opposite the upper bar portion of the winding core is a slot formed from the bottom edge of the core which is configured to engage a mating slot formed in a rotating drive shaft for rotationally interlocking the winding core to the drive shaft. Further, an unwinding stand is provided which supports the winding core carrying a supply of continuous belt wound thereon. The unwinding stand includes a support frame having wheels at one end and an adjustment screw assembly at an opposite end adapted to tilt one side of the unwinding stand to facilitate removal of the belt wound onto the winding core. A gripping assembly is rotationally mounted to the winding stand for removably gripping the winding core carrying the supply of wound belt.

4 Claims, 6 Drawing Sheets

FLEXIBLE BAG WINDING AND UNWINDING APPARATUS

BACKGROUND OF THE INVENTION

The present invention concerns apparatus for the winding and unwinding of continuing belt of flexible bag. Specifically, the invention contemplates one apparatus for winding continuous belt of flexible bag provided by a bag producing machine and a further device for unwinding the same continuous belt of flexible bag to be provided to a packaging machine.

The inexpensive, disposable flexible plastic bag enjoys a prominent position in the packaging industry. Typically, such bags are constructed of a variety of types of materials, with thermoplastics being the most prominent. These bags can be filled with a variety of products either in liquid, powder or solid form.

One of the benefits of this type of flexible packaging is that it can be relatively inexpensively produced in large quantities. Typically, the bags are produced on a continuous belt from a continuous sheet of bag material. Bag forming mechanisms are well known that can take the continuous sheet of bag material, fold it into a general package shape, and then seal and cut at respective locations forming the sides and tops of the package. These same bag forming machines also include the capability of adding reclosable features which permit opening and closing the bags. These reclosable features are usually in the form of interlocking male and female zipper elements.

One such type of package is shown in FIG. 1 as a continuous belt 10 of flexible packaging produced from a bag manufacturing machine in accordance with principles known to persons of skill in the art. This continuous belt 10 includes a series of consecutive packaging blanks 11, each separated by vertical slots 12. Each of the packaging blanks 11 include bonding zones 13 at the vertical slots 12 to form the sides of each of the bags. In addition, bridges 14 are provided to span across the vertical slots 12 at the lower edges of the bag to at least maintain the continuity of the bags during the bag forming and filling processes. The upper edge 15 of the continuous belt 10 is open for access at a subsequent product filling station.

In accordance with one particular type of continuous belt of packaging blanks, the belt 10 is provided with a pair of longitudinal tunnels 17, 18 on opposite sides of the open upper edge 15 of the belt. This upper edge, including the longitudinal tunnel 17, 18, can be removed from the remainder of the bag at perforations 16. A bag of this type is described more particularly in U.S. Pat. No. 4,558,556 to Jostler, which disclosure is incorporated herein by reference. As discussed in more detail in the '556 patent, along with continuation U.S. Pat. No. 4,598,421 and divisional U.S. Pat. No. 4,756,144 deriving priority therefrom, the longitudinal tunnels 17 are formed to ride along guide bars at a product filling machine. One commercial embodiment of this machine is the Joker Combi Line Packaging System sold by Joker System Aktiebolag. In accordance with this system, and again as more fully described in the '556 patent incorporated by reference, the guide bars are configured to alternatively open and close the upper edge of each of the consecutive packaging blanks 11 as the continuous belt 10 rides along the guide bar supported within the paid of longitudinal tunnels 17, 18. Further details of the filling apparatus and method can be discerned from each of the three Jostler patents.

As depicted in FIG. 4 of the Jostler '556 patent incorporated by reference, the continuous belt of packaging blanks is drawn from a horizontal stack in a magazine 21. In the case of the system depicted in these patents, the continuous belt of packaging blanks must be first provided in stacks to be housed within the magazines. In other systems, the continuous belt of packaging blanks is provided on a drum or continuous roll. A roll of this type is depicted in the patent to Collin, U.S. Pat. No. 4,260,116. A similar drum of continuous belt of packaging blanks is also shown in U.S. Pat. No. 3,751,875 to Membrino and U.S. Pat. No. 3692,251 to Melead.

Thus far in the prior art, the continuous packaging blanks are provided either vertically stacked in a magazine, such as shown in the Jostler '556 patent, or on a cylindrical drum, as described in the Collin patent. With each of these techniques, however, some difficulty arises when the upper edge of the packaging blanks includes functional features, such as the longitudinal tunnels 17 and 18 depicted in FIG. 1 of the present application. In other words, the addition of these features makes the upper edge of the continuous belt 10 thicker than the remainder of the bags, which can lead to uneven stacking and uneven dispensing on the cylindrical rolls. The present invention addresses this difficulty in a novel bag winding and pay-out system.

SUMMARY OF THE INVENTION

In one aspect of the invention, a vertical winding apparatus is provided for winding a continuous belt of packaging blanks generated by a bag producing machine. In one embodiment, the vertical winding apparatus includes a winding core generally formed from a flat sheet of material, such as wood or metal, and having an irregular trapezoidal shape. The winding core can include an upper bar separated from a lower body by a pair of opposite support notches. The notches are formed in the core to receive the upper edge of the continuous belt of packaging blanks, particularly packaging blanks having some type of reclosable or guide feature at its upper edge.

Opposite the upper bar portion of the winding core is a slot formed from the bottom edge of the core in one embodiment. This slot is configured to engage a mating slot formed in a drive shaft for rotationally interlocking the winding core to the drive shaft. The drive shaft is supported by a bearing system and driven by a D.C. drive motor and belt arrangement. Preferably, the speed and tension of the motor driving the winding core is controlled by a dual type controller "speed & torque", tuned by two potentionmeters located on the controller. The entire vertical winding apparatus is supported on a base having wheels so that the winding apparatus can be moved to different bag producing machines.

In a further aspect of the invention, a dancer roller assembly can be provided for maintaining appropriate tension on the continuous belt as it travels from the bag producing machinery to the vertical winding apparatus. The dance roller accommodates the forgiveness of the interrupted cycle of the bag machine and the continuous motion of the winder. In one embodiment, the dancer roller assembly includes a support plate which is configured to engage the vertical winding apparatus at the machine site. A vertical support projects upward from the support plate and carries at its top end an upper support plate. A roller arrangement is carried between upper and lower pivot plates, each similarly configured to include an offset pivot flange. The flanges of each of the pivot plates are engaged respectively to the upper support plate and the lower support plate by way of a pivot rod. In one roller arrangement, a pair of upstream rollers are disposed on one side of the pivot flanges and a single downstream roller is disposed on the opposite side. The downstream roller can include a travel limiting ring to prevent upward migration of the continuous belt as it rolls through the dancer roller assembly. The upper pivot plate is connected to the upper support plate by way of a tension spring. The tension spring is calibrated to counter the tension imposed by the continuous belt of packaging blanks passing through the dancer roller assembly to the vertical winding apparatus.

In a further aspect of the invention, an unwinding stand is provided which supports the winding core carrying a supply of continuous belt wound thereon. The unwinding stand includes a support frame having wheels at one end and an adjustment screw assembly at an opposite end. In particular, the adjustment screw assembly can tilt one side of the unwinding stand to facilitate removal of the belt wound onto the winding core. The provision of the adjustment screw with the unwinding stand allows adjustment of the height of one side of the support frame, and thereby adjusting the angle at which the winding core is oriented. Thus, the winding core as supported by the unwinding stand can be oriented in whatever position facilitates unwinding of the continuous belt from the winding core by direct tension. A gripping assembly is rotationally mounted to the winding stand for removably gripping the winding core carrying the supply of wound belt. In one embodiment, the gripping assembly includes a pair of resiliently sprung gripping fingers and a collet arrangement to draw the fingers into gripping contact with the winding core.

It is one object of the present invention to provide a winding and unwinding arrangement utilizing a common carrier for supporting the wound packaging blank materials. A further object is to provide a vertical winding apparatus that can readily wind and support packaging blanks having thicker features at the upper edge of the continuous belt. These and other objects are satisfied by the present invention as disclosed in the following written description and accompanying figures.

DESCRIPTION OF THE PREFERRED EMBODIMENTS

Figure 1:
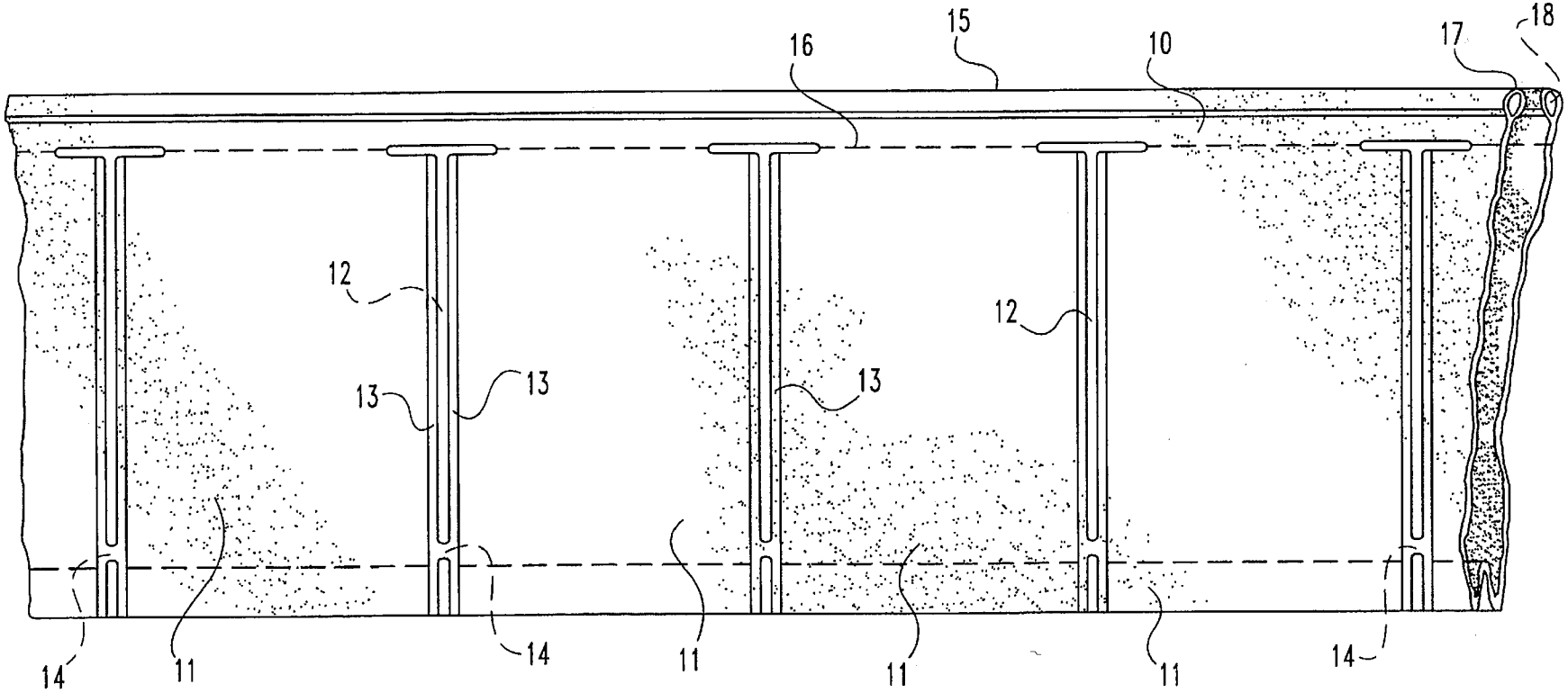
FIG. 1 is a partial cut-away side elevational view of a continuous belt of packaging blanks used with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In accordance with one aspect of the present invention, a vertical winding apparatus 20 is provided for receiving a continuous belt of flexible packaging blanks, such as the continuous belt 10 shown in FIG. 1, as the belt is produced by a bag manufacturing machine. Central to this vertical winding apparatus 20 is a winding core 22, which can be formed of any suitable material such as wood or metal. Preferably, the winding core is formed of wood to be lightweight yet strong enough to support a large quantity of continuous belt wound therearound. The winding core 22 includes an upper bar portion 23 and a lower body 25. The upper bar 23 is separated from the body at a pair of support notches 24 on opposite sides of the winding core. The lower body 25 is also defined by angled side edges 26 so that the winding core 22 has a smaller width at its bottom edge 28 than at the upper bar 23. The lower body 25 also defines a slot 27 extending upward from the bottom edge 28. For simplicity, the winding core 22 is preferably formed as a flat sheet. However, it is contemplated that the core could have some contour or curvature to it as necessary for firmly supporting a continuous belt of packaging blanks wound around the core.

Figure 2:
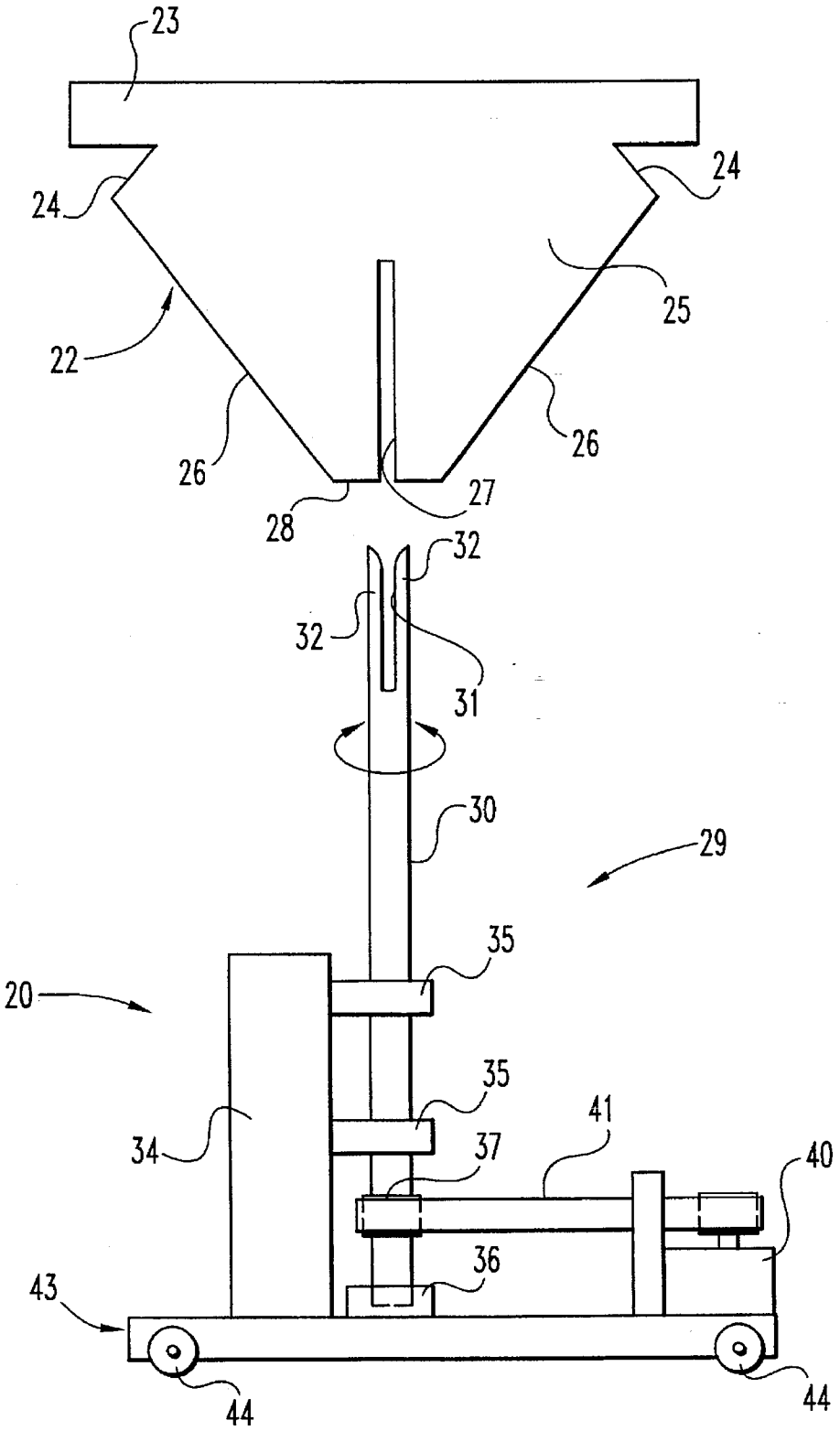
FIG. 2 is a partial exploded side elevational view of a vertical winding apparatus in accordance with one aspect of the present invention.

Another element of the vertical winding apparatus 20 of the preferred embodiment is the rotary drive system 29. This drive system includes a drive shaft 30 configured to mate with and support the winding core 22. In particular, the drive shaft 30 includes a mating slot 31 defined by a pair of opposite support fingers 32. The slot 31 in the drive shaft 30 has a width slightly larger than the thickness of the winding core 22. Likewise, the slot 27 defined in the winding core 22 has a width slightly larger than the dimension of the drive shaft. In FIG. 2, the slot 27 of the winding core 22 is shown rotated 90 degrees from the orientation necessary to mate with the mating slot 31 of the drive shaft 30. It is of course understood that the two slots 27 and 31 slide together so that the support fingers 32 extend beyond the end of the slot 27 in the winding core and in contact with the upper bar portion 23 of the core. In this preferred embodiment, the slots 27 and 31 mate to firmly support the winding core 25. Alternatively, only one slot may be provided in either the core 25 or drive shaft 30 to fit over the other non-slotted component. The drive system 29 further includes a support body 34 carrying a pair of bearing supports 35 disposed apart to rotationally support the drive shaft 30. The bearing supports 35 can be of many known construction provided that some bearing surface is available against which the drive shaft 30 can rotate. The bottom of the drive shaft 30 can be further supported on a bearing base 36, which also includes a bearing surface to permit rotation of the shaft. Adjacent the bottom of the drive shaft is a drive collar 37 which is affixed to the shaft. The drive collar is adapted to be engaged by a drive belt 41 running from a drive motor 40. The drive motor 40 rotates the drive belt 41, which in turn rotates the drive shaft 30 and winding core 22 engaged thereon. The entire drive system 29 is supported on a mobile base 43 having a set of wheels 44. This mobile base allows the vertical winding apparatus 20 to be transferred among several bag forming machines as required.

Figure 3:
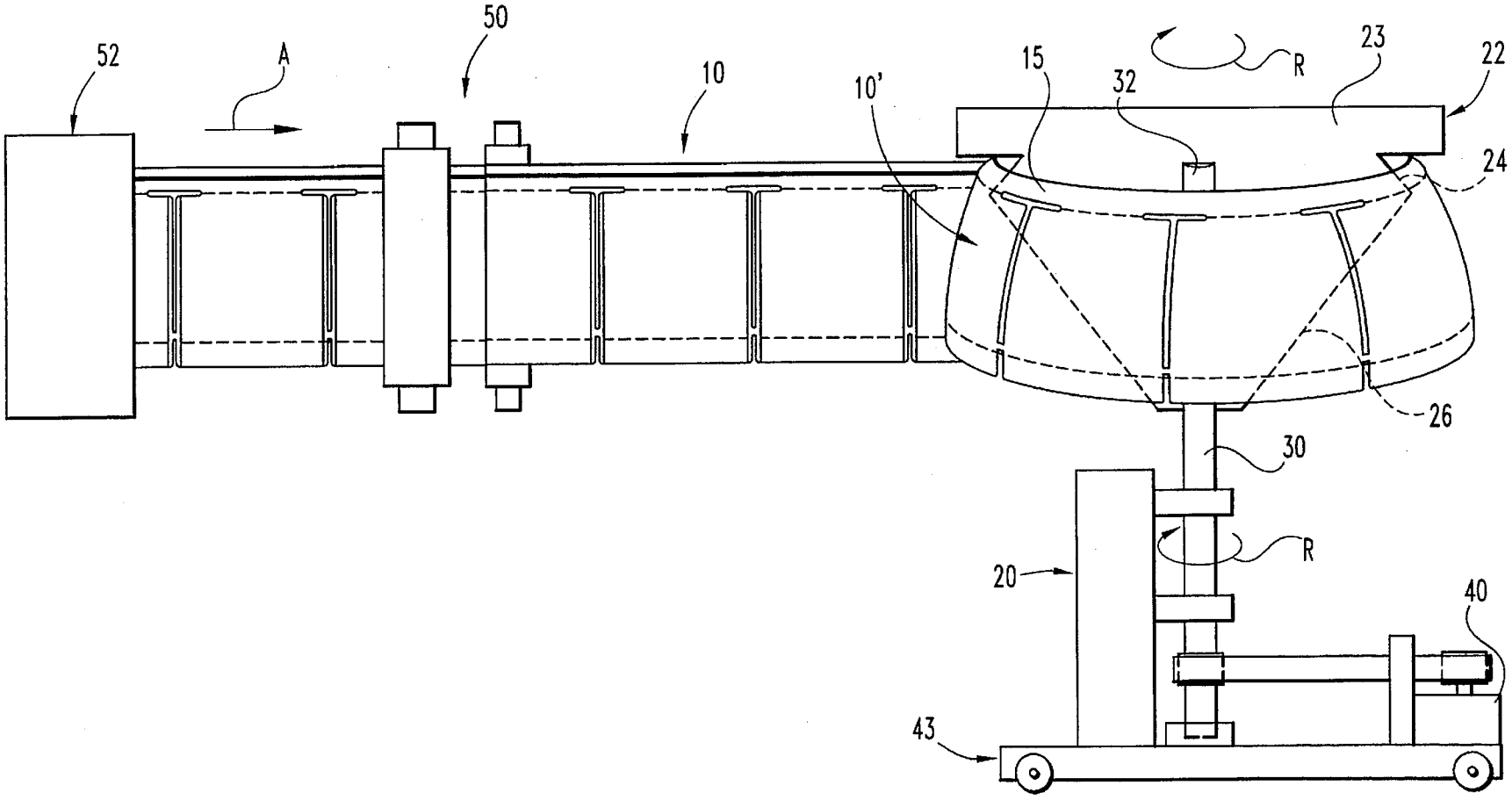
FIG. 3 is a side view of the vertical winding apparatus shown in FIG. 2 used with the continuous belt of flexible packaging shown in FIG. 1 to illustrate the manner in which the continuous belt is wound onto the vertical winding apparatus.

Referring now to FIG. 3, the vertical winding apparatus 20 is shown in one operating position. In particular, the winding core 22 is engaged on the drive shaft 30 in the manner described above. A flexible bag producing machine 52 is shown schematically, it being understood that a wide variety of such machinery can produce a wide range of flexible packages on a continuous belt usable with the present invention. As the continuous belt 10 of flexible package blanks is produced, it travels in the direction of the arrow A toward the idler rollers 50, which are configured to maintain appropriate tension on the continuous belt of packaging blanks. It is of course known in the art that too little tension or too much tension can cause the continuous belt of packaging blanks to bind or tear before it reaches the vertical winding apparatus 20.

As the new packaging blanks 11 in the continous belt 10 are produced by the machinery 52, they are collected on the winding core 22 of the vertical winding apparatus 20 by rotation of the drive shaft 30 and core 22 in the direction of the arrow R surrounding the shaft. The upper edge 15 of the continuous belt 10 is engaged within the support notches 24 on opposite sides of the core 22. Although not shown in FIG. 3, the continuous belt 10 can be initially attached to the winding core 22 by simply taping or otherwise fastening a portion of the upper edge 15 to the core 22. On the other hand, the belt can also be sufficiently held in position until the winding process starts by wedging the upper edge 15 of one of the packaging blanks 11 into one of the support notches 24. Once the belt is wound a few turns around the winding core 22, as represented by the wound belt 10', the natural tension and pressure of the wound belt will keep it in position on the support notches 24.

As can be seen from FIG. 3, the support notches 24 provide adequate space for the thicker features at the upper edge 15 of the continuous belt 10. The length of the upper bar portion 23 can be established so that there is adequate purchase on the core 22 to keep the wound belt 10' from slipping off of the core. In other words, in the preferred use of the vertical winding apparatus and winding core 22, the continous belt will be wound around the core 22 until the wound belt 10' extends beyond the ends of the upper bar portion 23.

In the embodiment shown in FIG. 3, a set of idler rollers 50 are depicted to maintain tension on the continuous belt 10 as it is wound around the winding core 22 of the vertical winding apparatus 20. Preferably, the motor 40 is synchronized with the bag producing machinery so that the winding core 22 rotates at an appropriate pace to receive the continuous belt material 10 as it is generated by the bag producing machinery 52. This control interface is known in the art and is believed to be readily within the skill of persons in the art to appropriately time the vertical winding apparatus 20 with the bag producing machinery 52. However, in the event that the vertical winding apparatus 20 moves too fast or too slow, the idler rollers 50 will take up the tension in the continuous belt 10.

Figure 4:
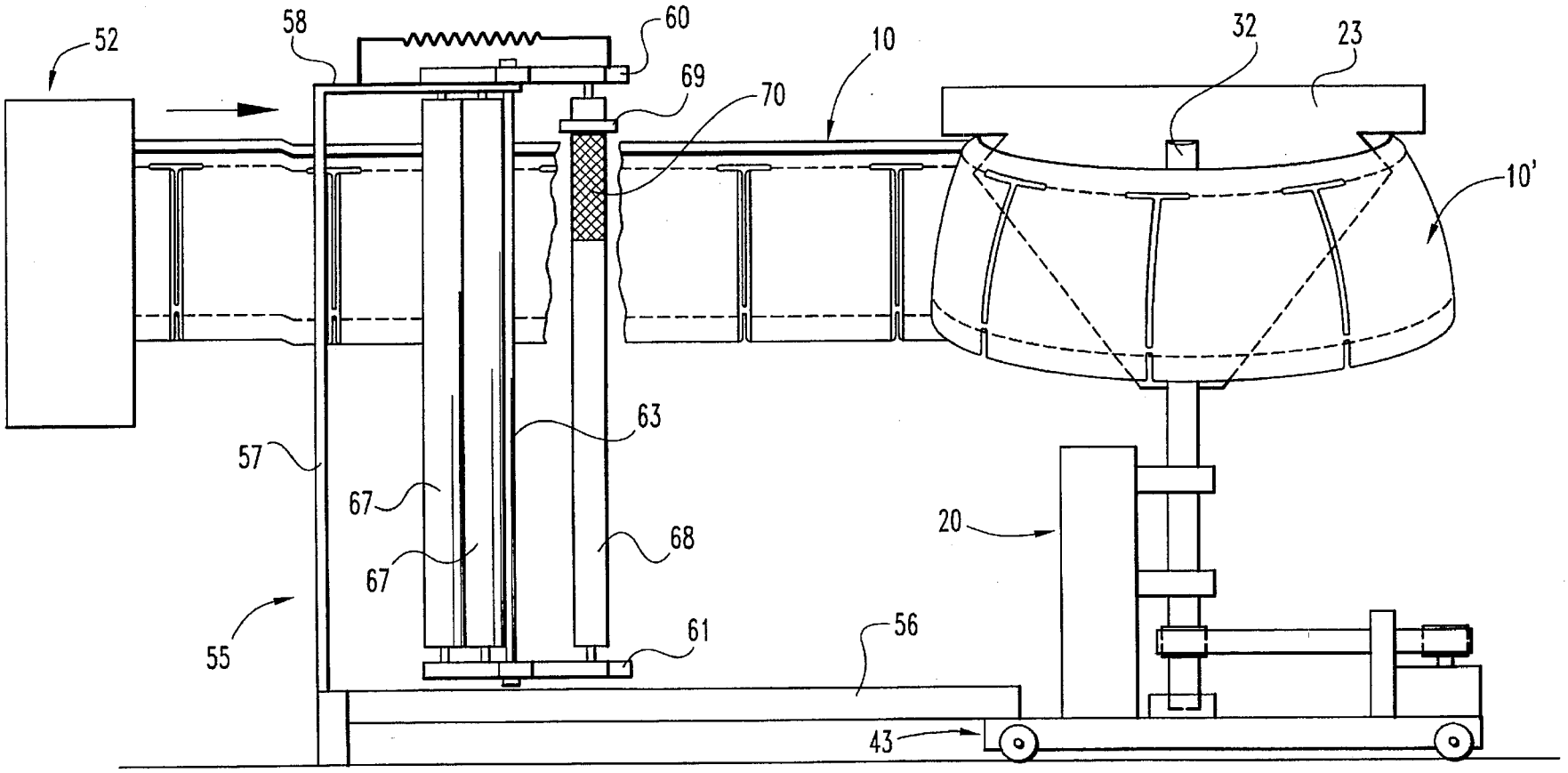
FIG. 4 is a side view showing a dancer/roller assembly in accordance with another aspect of the invention, as used with the vertical winding apparatus shown in FIG. 2, with a continuous belt of packaging material, as shown in FIG. 1, passing from the vertical winding apparatus through the dancer/roller assembly.
Figure 5:
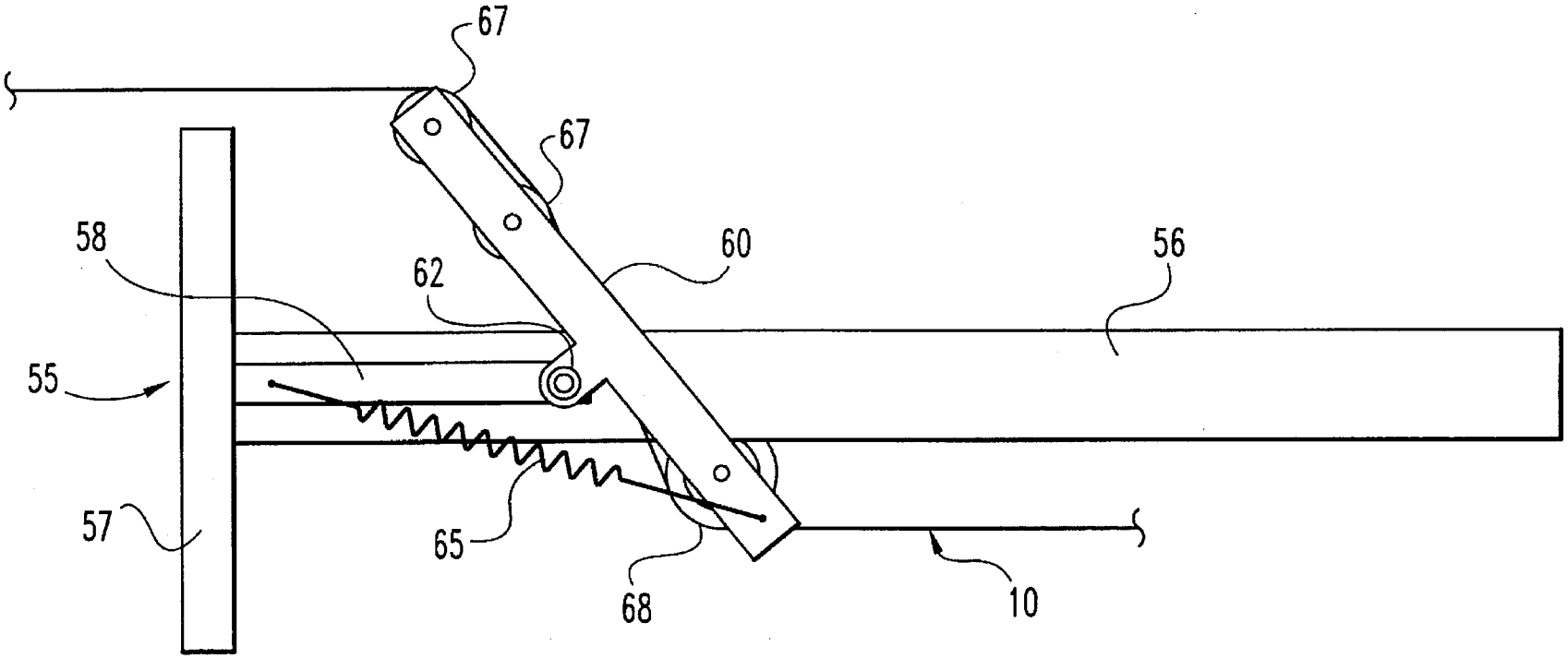
FIG. 5 is a top elevational view of the dancer/roller assembly.

In another aspect of the invention, the idler rollers 50 can be replaced by a dancer roller assembly 55, as shown in FIGS. 4 and 5. Specifically, the dancer roller assembly 55 includes a support plate 56 which can rest on the base 43 of the vertical winding apparatus 20, as shown in FIG. 4. The support plate 56 includes a vertical support 57 extending therefrom which terminates at its upper end in an upper support plate 58. The assembly 55 further includes an upper pivot plate 60 and a lower pivot plate 61 which carry an arrangement of tension rollers. The upper and lower pivot plates 60 and 61 have a similar configuration, as shown more clearly in FIG. 5. In particular, the plates include a pivot flange 62 offset from the plates 60, 61. A pivot rod 63 extends through both pivot flanges and through the upper support plate 58. The bottom of the pivot rod 63 is supported by the lower support plate 56. Each of the upper and lower pivot plates 60 and 61 are fixed to the pivot rod 63 to rotate or pivot with the rod, while the rod itself rotates relative to the lower support plate 56 and the upper support plate 58. Preferably, the support plates include some bearing surface against which the pivot rod 63 can smoothly rotate. The upper pivot plate 60 is further connected to the upper support plate 58 by way of a tension spring 65. The tension spring 65 inherently biases the upper pivot plate 60 to a particular orientation, in the absence of tension supplied by the continuous belt passing through the roller arrangement.

The roller assembly 55 further includes a pair of upstream rollers 67 which are rotatably supported between the upper pivot plate 60 and the lower pivot plate 61. The rollers 67 are denoted the upstream rollers because they are closest to the bag producing machinery 52. This pair of upstream rollers 67 is supported to one side of the pivot flange 62 of both of the upper and lower pivot plates 60, 61. On the opposite side of the plates, and particular opposite from the respect of the pivot flange 62, is a downstream roller 68. The downstream roller 68 can include a travel limiting ring 69 which prevents the continuous belt from riding too far up the rollers as the belt passes through the roller assembly 55. The downstream roller 68 can also include an engagement surface 70 which is textured to provide a greater amount of frictional contact with the continuous belt 10 as it passes through the rollers. As shown most clearly in FIG. 5, the continuous belt is wound through the dancer roller assembly so as to react the tension of the continuous belt against the tension in the tension spring 65.

One of the benefits of the present invention is realized by the provision of the winding core 22. As previously described, the winding core 22 forms part of the vertical winding apparatus 20 and is readily supported by the rotating drive shaft 30. The drive shaft is rotated to wind a continuous belt 10 of packaging blanks 11 onto the core. Once a winding core is full of wound belt 10', it can be easily removed from the vertical winding apparatus 20 by simply disengaging the core slot 27 from the mating slot 31 of the drive shaft 30, preferably by lifting the winding core off of the drive shaft 30. The winding core 22, now fully loaded with a wound belt 10', can then be transferred to an unwinding stand, such as stand 75 depicted in FIGS. 6–7. The unwinding stand 75 would be positioned at the feed end of bag filling machinery. In other words, referring back to the Jostler '556 Patent incorporated by reference, the unwinding stand 75 would replace the cartridge 21 shown in FIG. 4 of that prior patent.

Figure 6:
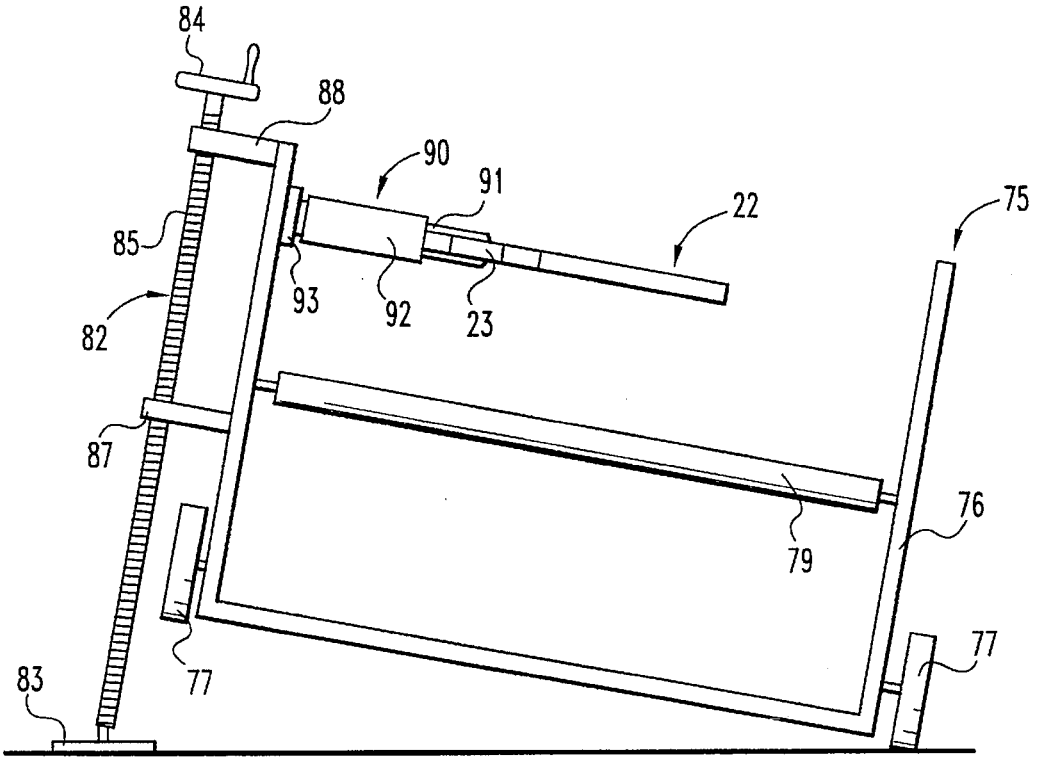
FIG. 6 is an end view of an unwinding stand in accordance with another aspect of the present invention.

Again referring to FIGS. 6 and 7 of the present application, the unwinding stand 75 includes a support frame 76 having a pair of wheels 77 at one end. The stand also includes a frame extension 78 extending from the opposite end of the stand, at which a pay-out roller 79 is supported. The support frame 76 includes several support members, and particularly a side support arm 80. Adjacent this support arm 80 is an adjustment screw assembly 82. The adjustment screw assembly 82 includes a threaded shaft 85 carrying at one end a jack plate 83, and at the opposite end a crank 84. The jack plate 83 is configured to rest on the ground and provide a additional support surface when one side of the support frame 76 is lifted off the ground, as shown in FIG. 6. The support frame 76 includes a threaded collar 87 and a bearing collar 88 for supporting the threaded shaft 85 of the adjustment screw assembly 82. The threaded collar 87 is specifically provided to react to rotation of the threaded shaft 85. Thus, as the crank arm 84 is rotated to rotate the shaft 85, the mutually engaging threads between the shaft and the threaded collar 87 cause the side of the support frame 76 to raise from the ground. The opposite side of the frame is still supported by the wheel 77.

Figure 7:
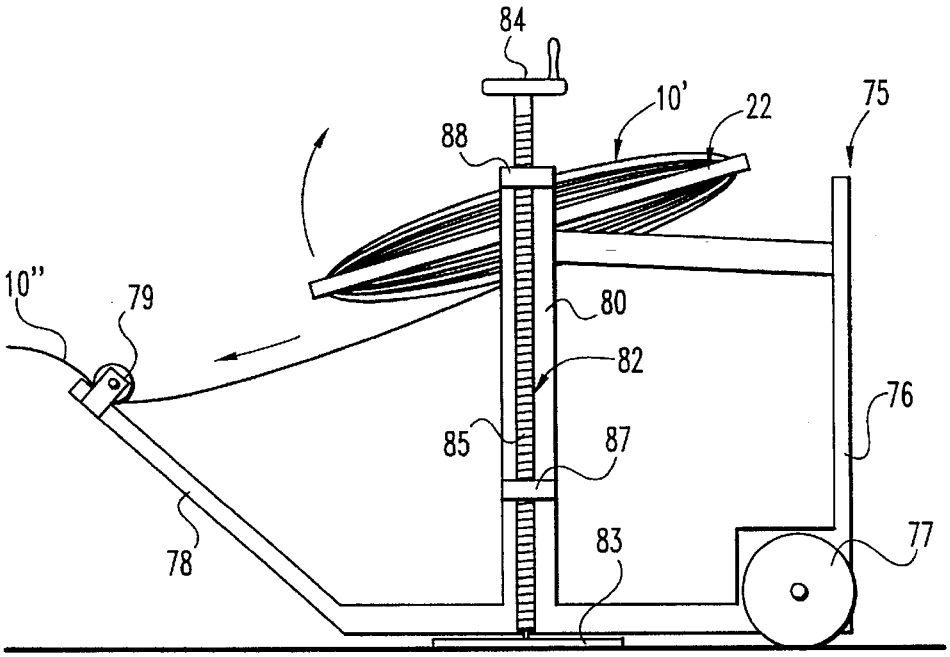
FIG. 7 is a side view of the unwinding stand shown in FIG. 6, with a continuous belt of packaging material being supported by a winding core on the unwinding stand.

The unwinding stand 75 further includes a core gripping assembly 90 which is configured to grip a winding core 22 carrying a supply of wound belt 10'. In one preferred embodiment, the core gripping assembly includes a pair of gripping fingers 91 that are sprung resiliently apart. A collet 92 is then provided which can be translated toward the end of the gripping fingers 91 to close the fingers about a winding core 22. In this manner, the winding core 22, and particularly the upper bar portion 23 can be firmly gripped between the fingers 91. The grip can be readily released by moving the collet 92 back toward the base of the fingers and away from the engaged winding core 22. The resilience of the gripping fingers 91 will cause them to spread apart allowing removal of the core. The gripping fingers 91 are supported on the side support arm 80 by a rotational mount 93. Thus, the core gripping assembly 90 is permitted to rotate or pivot, which means that the winding core supported by the assembly 90 is also free to rotate. As shown in FIG. 7, the lead end 10" of the wound belt 10' is fed through a pay out roller 79 and provided to an appropriate bag filling machine. The bag filling machine can be similar to that depicted in U.S. Pat. No. 4,558,556 incorporated above by reference. As the lead end 10" of the continuous belt is pulled toward the bag filling machinery, the wound belt 10' carried by the winding core 22 is gradually unwound from the core.

Adjustment of the screw assembly 82 tilts the stand 75 to thereby adjust the angle of the rotation axis of the winding core 22 held by the gripping assembly 90. The screw assembly 90 can thus orient the core axis at an acute angle relative to the ground to facilitate removal of the wound belt from the winding core.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A winding apparatus for winding a continuous belt of packaging blanks generated by a bag producing machine, comprising:

a winding core formed from a sheet of material and having a substantially trapezoidal shape, the winding core including an upper bar, a lower body and a pair of support notches, said support notches located at the boundary between said upper bar and said lower body, said notches adapted to receive the upper edge of the continuous belt of packaging blanks therearound;

a rotary drive motor; and means for engaging said winding core to said rotary drive motor to transmit rotational motion to said winding core.

2. The winding apparatus of claim 1, wherein said means for engaging includes:

a drive shaft driven by said rotary drive motor;

a slot defined at an edge of said winding core opposite said upper bar; and a mating slot defined in said drive shaft for rotational interlocking engagement with said slot of said winding core.

3. The winding apparatus of claim 1, wherein said lower body includes a lower edge opposite said upper bar and a pair of opposite side edges between said support notches and said lower edge, said side edges converging toward said lower edge.

4. The winding apparatus of claim 1, wherein said notches are triangular.

* * * * *